US010755850B2

(12) United States Patent
Tsukada et al.

(10) Patent No.: US 10,755,850 B2
(45) Date of Patent: Aug. 25, 2020

(54) THREE-PHASE AC REACTOR HAVING COILS DIRECTLY CONNECTED TO EXTERNAL DEVICE AND MANUFACTURING METHOD THEREOF

(71) Applicant: FANUC CORPORATION, Minamitsuru-gun, Yamanashi (JP)

(72) Inventors: Kenichi Tsukada, Yamanashi (JP); Masatomo Shirouzu, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 97 days.

(21) Appl. No.: 15/795,893

(22) Filed: Oct. 27, 2017

(65) Prior Publication Data

US 2018/0122564 A1 May 3, 2018

(30) Foreign Application Priority Data

Oct. 31, 2016 (JP) ..... 2016-213174

(51) Int. Cl.

| | |
|---|---|
| ***H01F 27/24*** | (2006.01) |
| ***H01F 27/30*** | (2006.01) |
| ***H01F 27/29*** | (2006.01) |
| ***H01F 41/10*** | (2006.01) |
| ***H01F 37/00*** | (2006.01) |
| ***H01F 27/02*** | (2006.01) |
| ***H01F 41/04*** | (2006.01) |

(52) U.S. Cl.

CPC ..... *H01F 27/306* (2013.01); *H01F 27/02* (2013.01); *H01F 27/24* (2013.01); *H01F 27/29* (2013.01); *H01F 37/00* (2013.01); *H01F 41/04* (2013.01); *H01F 41/10* (2013.01)

(58) Field of Classification Search

CPC ..... H01F 3/12

USPC ..... 336/5

See application file for complete search history.

(56) References Cited

U.S. PATENT DOCUMENTS

| | | | | |
|---|---|---|---|---|
| 4,639,705 | A | 1/1987 | Beisser | |
| 10,199,155 | B2 | 2/2019 | Ishigaki et al. | |
| 2007/0274027 | A1 | 11/2007 | Vetter et al. | |
| 2009/0261939 | A1* | 10/2009 | Shudarek | H01F 3/10 336/212 |
| 2013/0187741 | A1* | 7/2013 | Goodrich | H01F 3/10 336/170 |

(Continued)

FOREIGN PATENT DOCUMENTS

| | | | |
|---|---|---|---|
| CN | 201765902 | U | 3/2011 |
| CN | 202487364 | U | 10/2012 |

(Continued)

OTHER PUBLICATIONS

English translation of W02010119324 (Year: 2010).*
English abstract of DE3001600 (Year: 1981).*

*Primary Examiner* — Ronald Hinson
(74) *Attorney, Agent, or Firm* — RatnerPrestia

(57) ABSTRACT

A three-phase AC reactor according to an embodiment includes a peripheral iron core that forms an outer periphery, and at least three iron core coils that are in contact with or connected to inner surfaces of the peripheral iron core. Each iron core coil includes an iron core and a coil wound around the iron core. The at least three iron core coils form gaps between the iron core coils adjoining each other so as to be magnetically connectable through the gaps. Each coil has coil extension members that extend from coil ends to connection points to an external device.

8 Claims, 15 Drawing Sheets

(56) References Cited

U.S. PATENT DOCUMENTS

| | | | |
|---|---|---|---|
| 2015/0179330 | A1 | 6/2015 | Nakanoue et al. |
| 2016/0125998 | A1 | 5/2016 | Bhide et al. |
| 2018/0090262 | A1 | 3/2018 | Tsukada et al. |

FOREIGN PATENT DOCUMENTS

| | | | |
|---|---|---|---|
| CN | 107871599 | A | 4/2018 |
| DE | 667093 | C | 11/1938 |
| DE | 1513862 | A1 | 4/1969 |
| DE | 4310199 | A1 | 10/1994 |
| DE | 19604192 | A1 | 9/1996 |
| DE | 102004010712 | A1 | 9/2005 |
| DE | 102017121535 | A1 | 3/2018 |
| FR | 1363289 | A | 6/1964 |
| FR | 2225820 | A2 | 11/1974 |
| JP | 4943123 | A | 4/1974 |
| JP | 50161623 | A | 12/1975 |
| JP | 60207320 | A | 10/1985 |
| JP | 2001167947 | A | 6/2001 |
| JP | A-2009-283706 | A | 12/2009 |
| JP | 2010252539 | A | 11/2010 |
| JP | 2011254005 | A | 12/2011 |
| JP | 2015050235 | A | 3/2015 |
| JP | 2015159657 | A | 9/2015 |
| JP | 2016122830 | A | 7/2016 |
| JP | 2016174043 | A | 9/2016 |
| WO | 2012157053 | A1 | 11/2012 |
| WO | 2014033830 | A1 | 3/2014 |
| WO | 2014073238 | A1 | 5/2014 |
| WO | 2014073252 | A1 | 5/2014 |

* cited by examiner

PRIOR ART

THREE-PHASE AC REACTOR HAVING COILS DIRECTLY CONNECTED TO EXTERNAL DEVICE AND MANUFACTURING METHOD THEREOF

CROSS-REFERENCE TO RELATED APPLICATIONS

This application is a new U.S. Patent Application that claims benefit of JP 2016-213174, filed Oct. 31, 2016, the disclosure of this application is being incorporated herein by reference in its entirety for all purposes.

BACKGROUND OF THE INVENTION

1. Field of the Invention

The present invention relates to a three-phase AC reactor and a manufacturing method thereof, and specifically relates to a three-phase AC reactor that has coils directly connected to an external device and a manufacturing method thereof.

2. Description of Related Art

Alternating current (AC) reactors are used in order to reduce harmonic current occurring in inverters and the like, to improve input power factors, or to reduce inrush current to inverters. AC reactors have a core made of a magnetic material and a coil formed around the core.

FIG. 1 shows the structure of a conventional three-phase AC reactor (for example, Japanese Unexamined Patent Publication (Kokai) No. 2009-283706). A conventional three-phase AC reactor 1000 includes three-phase coils 101*a*, 101*b* and 101*c* aligned in the directions of the double-headed arrow of FIG. 1. The coils 101*a*, 101*b* and 101*c* have output terminals 210*a*, 210*b* and 210*c* and input terminals 220*a*, 220*b* and 220*c*, respectively. In the conventional three-phase AC reactor, as shown in FIG. 1, the three-phase coils are arranged (apposed) in parallel and in a linear manner so as to align the three-phase coils and the input and output terminals. Thus, it is easy to connect a general-purpose input and output terminal base having linearly arranged input and output terminals to the input and output terminals of the three-phase AC reactor.

However, in recent years, three-phase AC reactors having three-phase coils that are arranged (apposed) neither in parallel nor in a linear manner have become known. To connect a general-purpose input and output terminal base to such a three-phase AC reactor, bus bars or cables are required to connect between coil ends and the input and output terminal base. This causes an increase in production man-hours. A plurality of types of relays have to be prepared depending on the variety of sizes of the three-phase AC reactors, thus requiring time, effort, and cost for management.

SUMMARY OF THE INVENTION

The present invention aims at providing a three-phase AC reactor the manufacturing cost of which is reduced by eliminating the need for providing relays and an input and output terminal base, and a manufacturing method of the three-phase AC reactor.

A three-phase AC reactor according to an embodiment includes a peripheral iron core that forms an outer periphery, and at least three iron core coils that are in contact with or connected to inner surfaces of the peripheral iron core. Each of the iron core coils includes an iron core and a coil wound around the iron core. The at least three iron core coils form gaps between the iron core coils adjoining each other so as to be magnetically connectable through the gaps. Each of the coils has coil extension members that extend from coil ends to connection points to an external device.

A method for manufacturing a three-phase AC reactor according to an embodiment is a method for manufacturing a three-phase AC reactor that includes a peripheral iron core forming an outer periphery, and at least three iron core coils that are in contact with or connected to inner surfaces of the peripheral iron core. Each of the iron core coils includes an iron core and a coil wound around the iron core. The at least three iron core coils form gaps between the iron core coils adjoining each other so as to be magnetically connectable through the gaps. The method includes the steps of forming coil extension members that extend from coil ends, inserting a coil holder to hold the coil extension members, and securing the coil extension members on the coil holder.

BRIEF DESCRIPTION OF THE DRAWINGS

The objects, features, and advantages of the present invention will become more apparent from the following description of embodiments along with the accompanying drawings. In the accompanying drawings.

DETAILED DESCRIPTION OF THE INVENTION

A three-phase AC reactor according to the present Invention will be described below with reference to the drawings.

Figure 1:
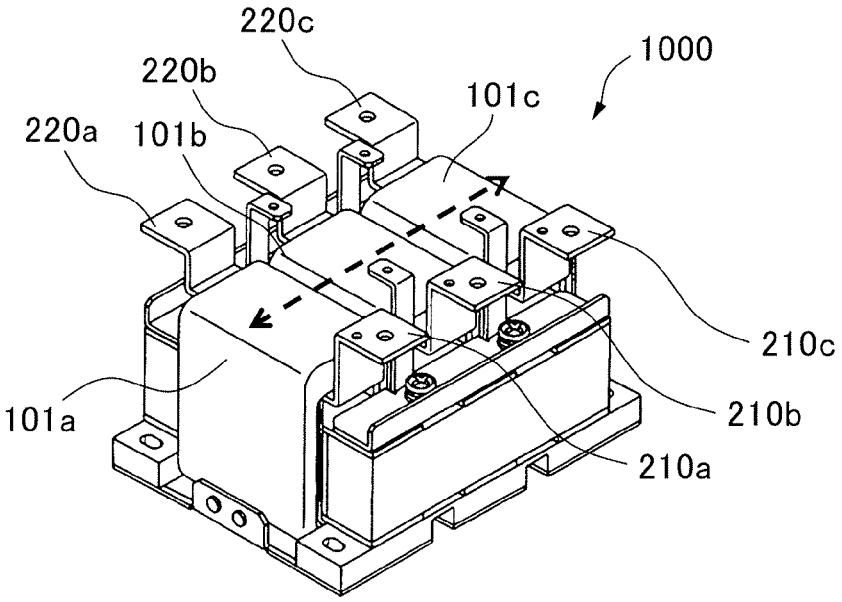
FIG. 1 is a perspective view of a conventional three-phase AC reactor.
Figure 2:
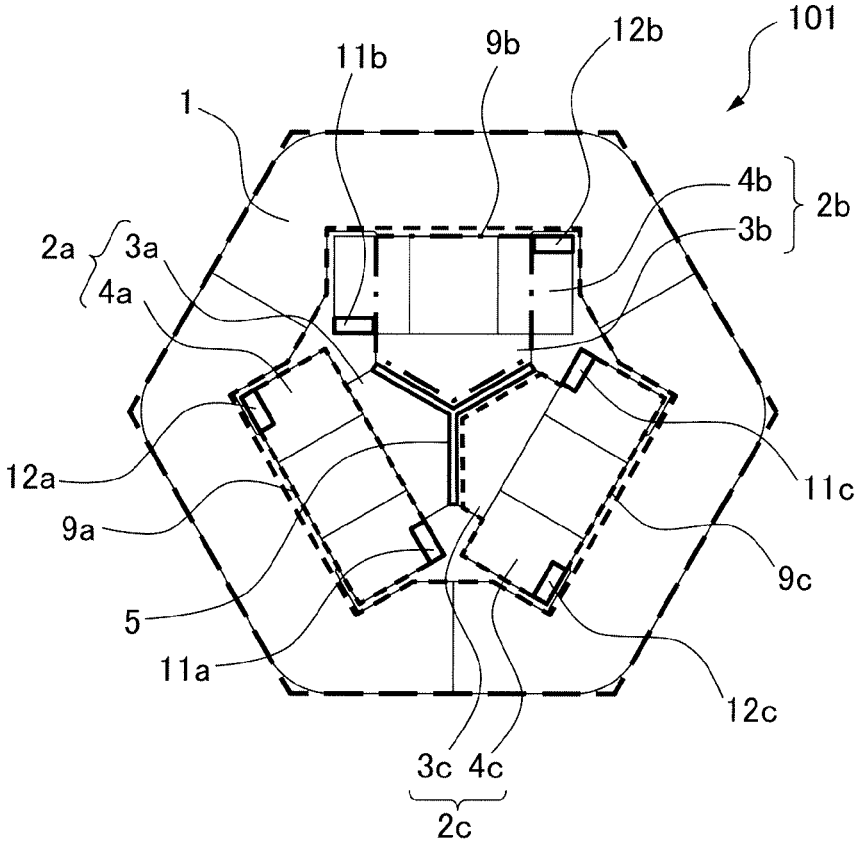
FIG. 2 is a plan view of the three-phase iron core coils and a peripheral iron core that constitute a three-phase AC reactor according to a first embodiment.
Figure 3:
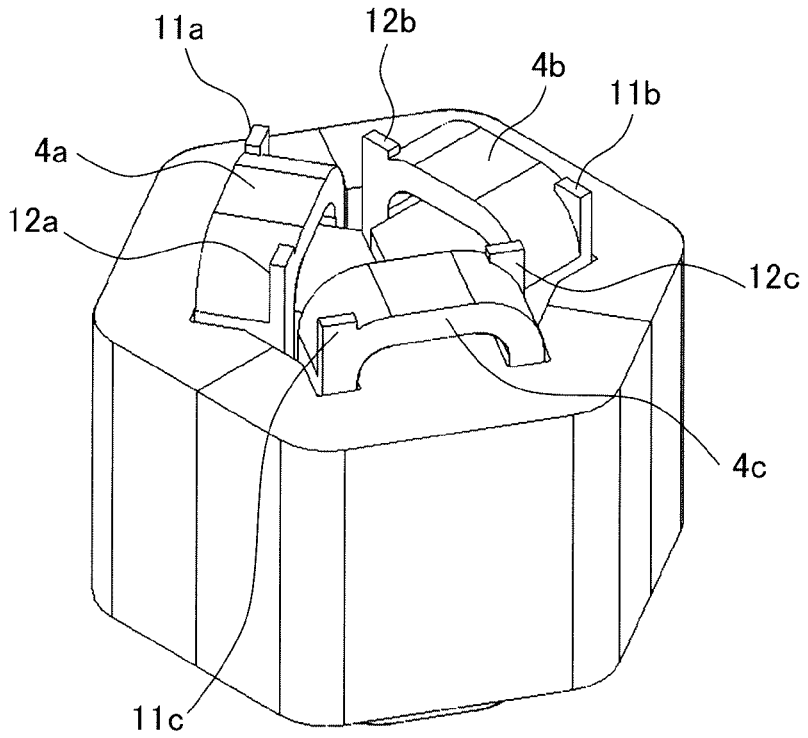
FIG. 3 is a perspective view of the three-phase iron core coils and the peripheral iron core that constitute the three-phase AC reactor according to the first embodiment.
Figure 4:
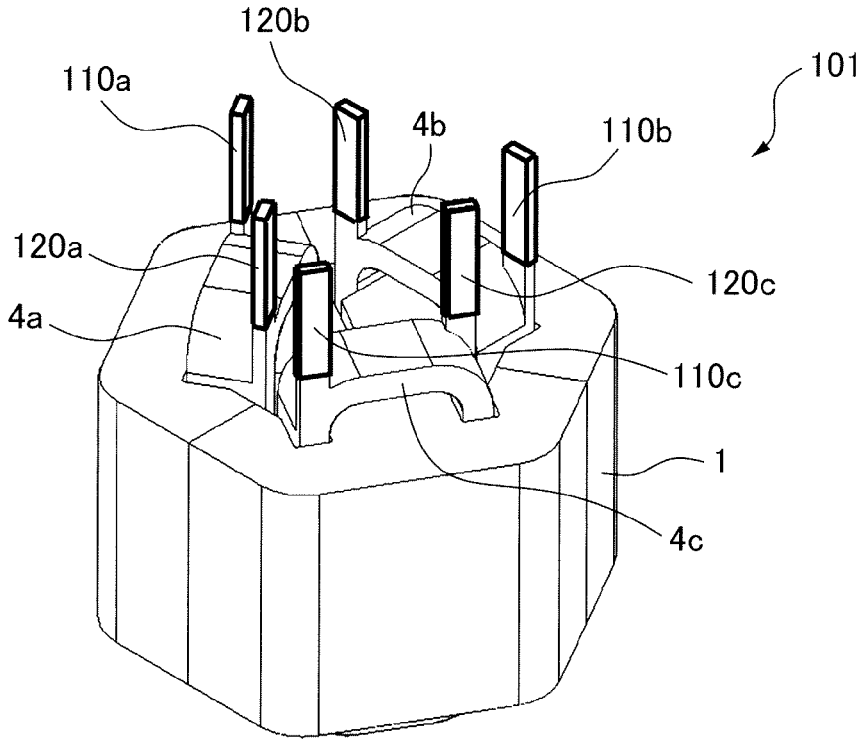
FIG. 4 is a perspective view of the three-phase AC reactor having coil extension members according to the first embodiment.

A three-phase AC reactor according to a first embodiment will be described. FIG. 2 is a plan view of the three-phase iron core coils and a peripheral iron core that constitute the three-phase AC reactor according to the first embodiment. FIG. 3 is a perspective view of the three-phase iron core coils and the peripheral iron core that constitute the three-phase AC reactor according to the first embodiment. FIG. 4 is a perspective view of the three-phase AC reactor having coil extension members according to the first embodiment.

A three-phase AC reactor 101 according to the first embodiment has a peripheral iron core 1, and at least three iron core coils (2*a*, 2*b*, and 2*c*). The peripheral iron core 1 forms the outer periphery of the three-phase AC reactor 101. The at least three iron core coils (2*a*, 2*b* and 2*c*) are in contact with or connected to inner surfaces of the peripheral iron core 1 at connection portions (9*a*, 9*b* and 9*c*), respectively. Each of the iron core coils (2*a*, 2*b* and 2*c*) includes an iron core (3*a*, 3*b* or 3*c*) and a coil (4*a*, 4*b* or 4*c*) wound around the iron core. The at least three iron core coils (2*a*, 2*b*, and 2*c*) form gaps 5 between the iron core coils adjoining each other so as to be magnetically connectable through the gaps 5.

Each of the coils (4*a*, 4*b* and 4*c*) has an input terminal (11*a*, 11*b* or 11*c*) and an output terminal (12*a*, 12*b* or 12*c*). The coils 4*a*, 4*b* and 4*c* may be an R-phase coil, an S-phase coil and a T-phase coil, respectively.

As shown in FIG. 4, the three-phase AC reactor according to the first embodiment has coil extension members (110*a*, 120*a*, 110*b*, 120*b*, 110*c* and 120*c*) that extend from coil ends (11*a*, 12*a*, 11*b*, 12*b*, 11*c* and 12*c* (see FIG. 2 or 3)) to an external device (not shown).

FIGS. 2 and 3 show the structure of the three-phase AC reactor before providing the coil extension members (110*a*, 120*a*, 110*b*, 120*b*, 110*c* and 120*c*) shown in FIG. 4 at the coil ends (11*a*, 12*a*, 11*b*, 12*b*, 11*c* and 12*c*).

As shown in FIG. 4, the coil extension member 110*a* is provided at the input terminal 11*a* of the first coil 4*a*, and the coil extension member 120*a* is provided at the output terminal 12*a* thereof. In the same manner, the coil extension member 110*b* is provided at the input terminal 11*b* of the second coil 4*b*, and the coil extension member 120*b* is provided at the output terminal 12*b* thereof. The coil extension member 110*c* is provided at the input terminal 11*c* of the third coil 4*c*, and the coil extension member 120*c* is provided at the output terminal 12*c* thereof.

The coil extension members (110*a*, 120*a*, 110*b*, 120*b*, 110*c* and 120*c*), which extend from the coil ends (11*a*, 12*a*, 11*b*, 12*b*, 11*c* and 12*c*) in structure, are preferably formed so as to be integral with windings of the coils (4*a*, 4*b* and 4*c*).

The coil extension members preferably have certain lengths and extend in a perpendicular direction. This structure allows the three-phase AC reactor to be directly connected to the external device (not shown). This eliminates the need for providing relays and an input and output terminal base to establish connection with the external device, thus allowing a reduction in manufacturing cost of the three-phase AC reactor.

Figure 5A:
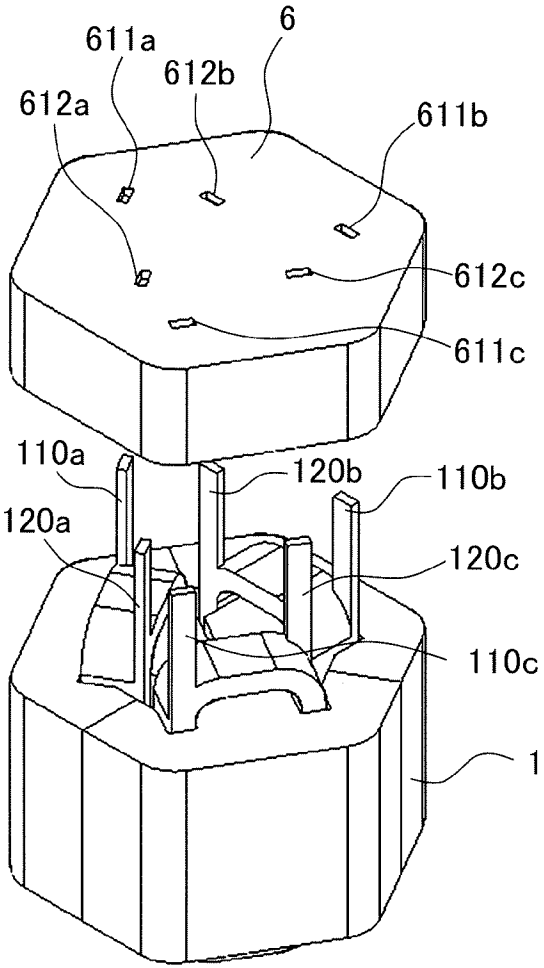
FIG. 5A is a perspective view of a three-phase AC reactor having a coil holder according to a second embodiment.
Figure 5B:
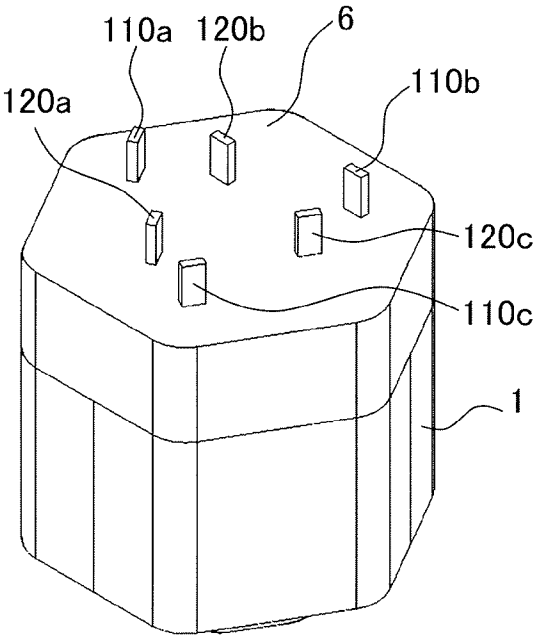
FIG. 5B is a perspective view of the three-phase AC reactor having the coil holder according to the second embodiment.
Figure 5C:
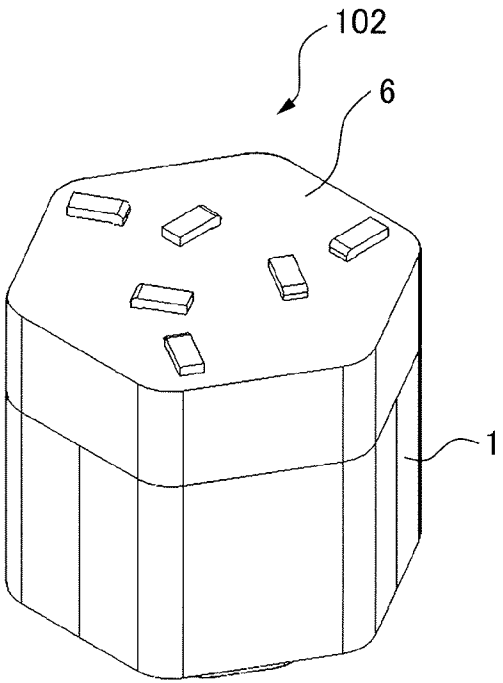
FIG. 5C is a perspective view of the three-phase AC reactor having the coil holder according to the second embodiment.

Next, a three-phase AC reactor according to a second embodiment will be described. FIGS. 5A to 5C are perspective views of the three-phase AC reactor having a coil holder according to the second embodiment. As shown in FIGS. 5A to 5C, the difference between a three-phase AC reactor 102 according to the second embodiment and the three-phase AC reactor 101 according to the first embodiment is that a coil holder 6 holds and secures the coil extension members (110*a*, 120*a*, 110*b*, 120*b*, 110*c* and 120*c*) in the three-phase AC reactor. The other structures of the three-phase AC reactor 102 according to the second embodiment are the same as those of the three-phase AC reactor 101 according to the first embodiment, so a detailed description thereof is omitted.

As shown in FIG. 5A, six openings (611*a*, 612*a*, 611*b*, 612*b*, 611*c* and 612*c*) are formed on a top surface of the coil holder 6 in positions corresponding to the six coil extension members (110*a*, 120*a*, 110*b*, 120*b*, 110*c* and 120*c*). FIG. 5A shows a state before mounting the coil holder 6 in the three-phase AC reactor, while FIG. 5B shows a state after mounting the coil holder 6 in the three-phase AC reactor. The coil holder 6 is preferably made of an insulating material.

As shown in FIG. 5B, when the coil holder 6 is mounted, part of the coil extension members protrude from the coil holder 6. In this state, the positions of the coil extension members can be secured to some extent.

FIG. 5C shows a state in which the coil extension members are altered in shape after mounting the coil holder 6 in the three-phase AC reactor. Since the part of the coil extension members, i.e., portions protruding from the coil holder 6 are altered in shape by bending and the like, the positions of the coil extension members can be secured more tightly in the perpendicular direction.

Figure 6B:
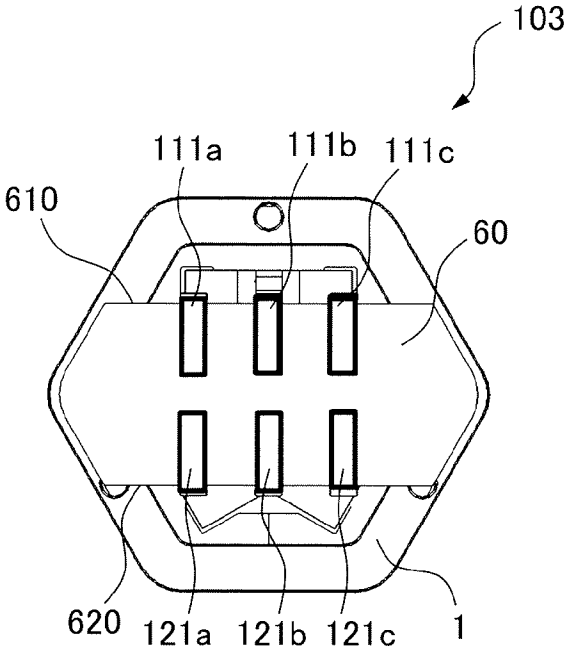
FIG. 6B is a plan view of the three-phase AC reactor having the coil holder according to the third embodiment.
Figure 6A:
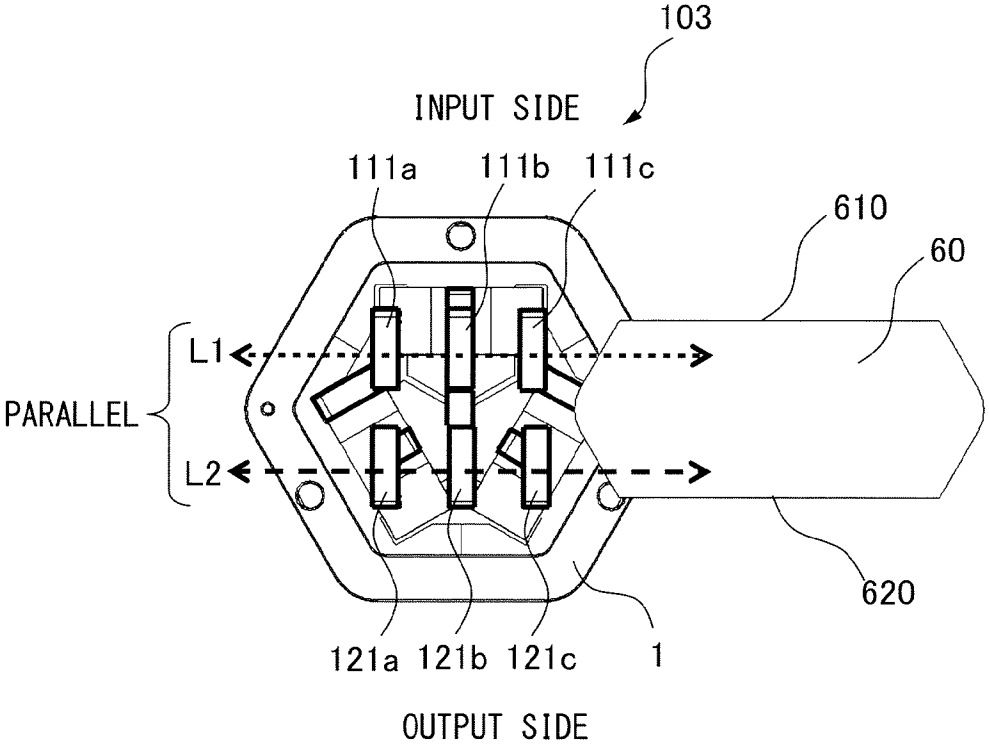
FIG. 6A is a plan view of a three-phase AC reactor having a coil holder according to a third embodiment.
Figure 7:
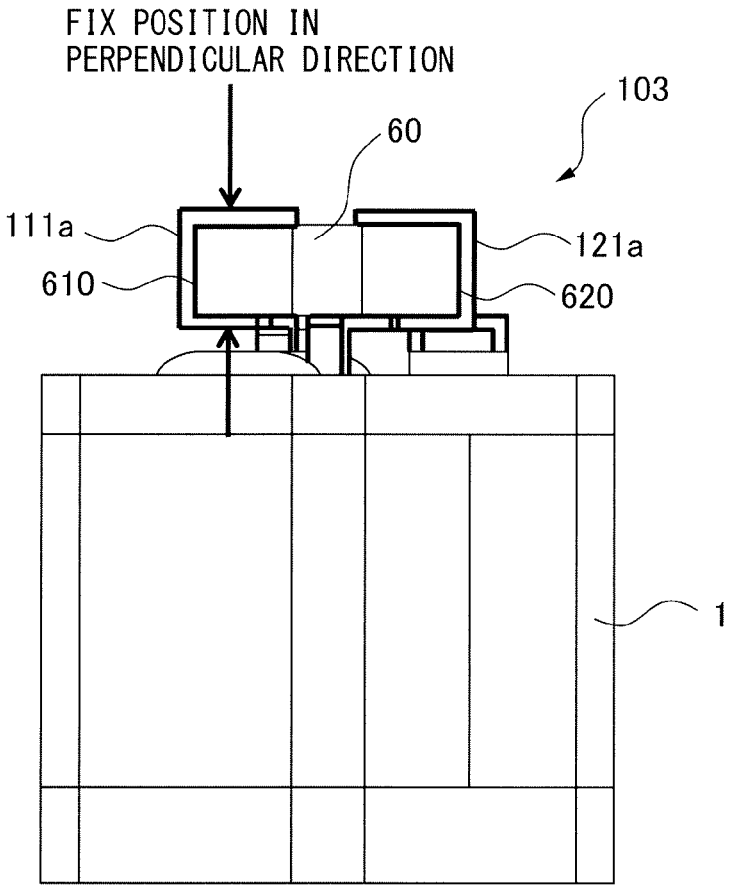
FIG. 7 is a side view of the three-phase AC reactor having the coil holder according to the third embodiment.

Next, a three-phase AC reactor according to a third embodiment will be described. FIGS. 6A and 6B are plan views of the three-phase AC reactor having a coil holder according to the third embodiment. FIG. 7 is a side view of the three-phase AC reactor having the coil holder according to the third embodiment. The difference between a three-phase AC reactor 103 according to the third embodiment and the three-phase AC reactor 101 according to the first embodiment is that, out of coil extension members (111*a*, 121*a*, 111*b*, 121*b*, 111*c* and 121*c*), input-side coil extension members (111*a*, 111*b* and 111*c*) are aligned along a first straight line L1 so as to enclose one side surface 610 of a coil holder 60, while output-side coil extension members (121*a*, 121*b* and 121*c*) are aligned along a second straight line L2 so as to enclose the other side surface 620 of the coil holder 60, and the first straight line L1 and the second straight line L2 are in parallel. The other structures of the three-phase AC reactor 103 according to the third embodiment are the same as those of the three-phase AC reactor 101 according to the first embodiment, so a detailed description thereof is omitted.

FIG. 6A shows a state before mounting the coil holder 60 in the three-phase AC reactor, while FIG. 6B shows a state after mounting the coil holder 60 in the three-phase AC reactor. The coil extension members (111*a*, 121*a*, 111*b*, 121*b*, 111*c* and 121*c*) according to the third embodiment have different shapes from the coil extension members (110*a*, 120*a*, 110*b*, 120*b*, 110*c* and 120*c*) according to the second embodiment. Each of the coil extension members (111*a*, 121*a*, 111*b*, 121*b*, 111*c* and 121*c*) has a shape of the letter C (see 111*a* of FIG. 7) or a shape of an inverted letter C (see 121*a* of FIG. 7) in a portion contacting the coil holder 60 by being bent a plurality of times. Furthermore, end portions of the input-side coil extension members (111*a*, 111*b* and 111*c*) are aligned along the first straight line L1, while end portions of the output-side coil extension members (121*a*, 121*b* and 121*c*) are aligned along the second straight line L2. The first straight line L1 and the second straight line L2 are in parallel. The coil holder 60 may be made of an insulating material.

The coil holder 60 according to the third embodiment includes the two side surfaces 610 and 620, in contrast to the coil holder 6 according to the second embodiment in structure. The input-side coil extension members (111*a*, 111*b* and 111*c*) are formed so as to enclose one of the side surfaces 610 of the coil holder 60, while the output-side coil extension members (121*a*, 121*b* and 121*c*) are formed so as to enclose the other side surface 620 of the coil holder 60. As a result, since the coil extension members form space to dispose the coil holder 60 therein, the coil holder 60 can be mounted after altering the shapes of the coil extension members, thus allowing a reduction in production man-hours. Furthermore, as shown in FIG. 7, for example, by bending the end portions of the coil extension members 111*a* and 121*a* along a top surface of the coil holder 60, the positions of the coil extension members can be secured in the perpendicular direction.

Figure 8B:
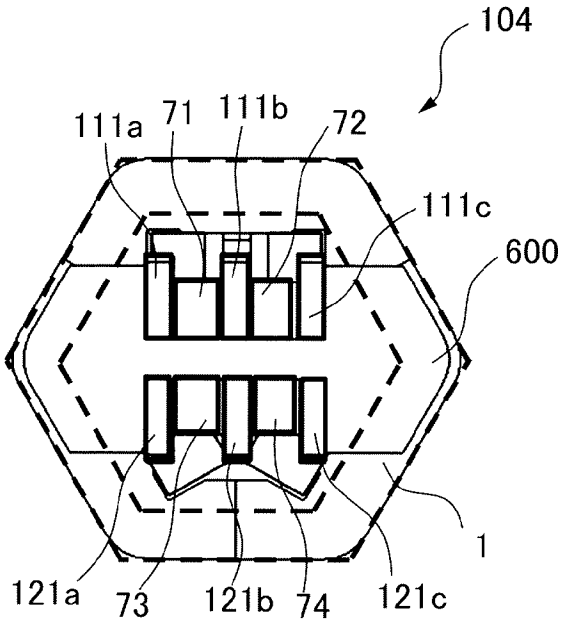
FIG. 8B is a plan view of the three-phase AC reactor having the coil holder according to the fourth embodiment.
Figure 8A:
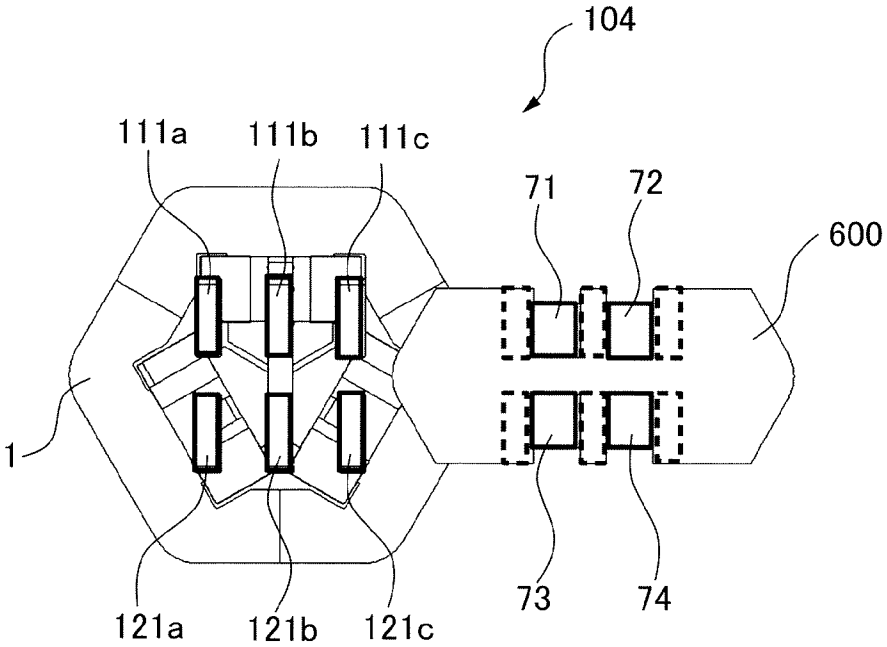
FIG. 8A is a plan view of a three-phase AC reactor having a coil holder according to a fourth embodiment.
Figure 9B:
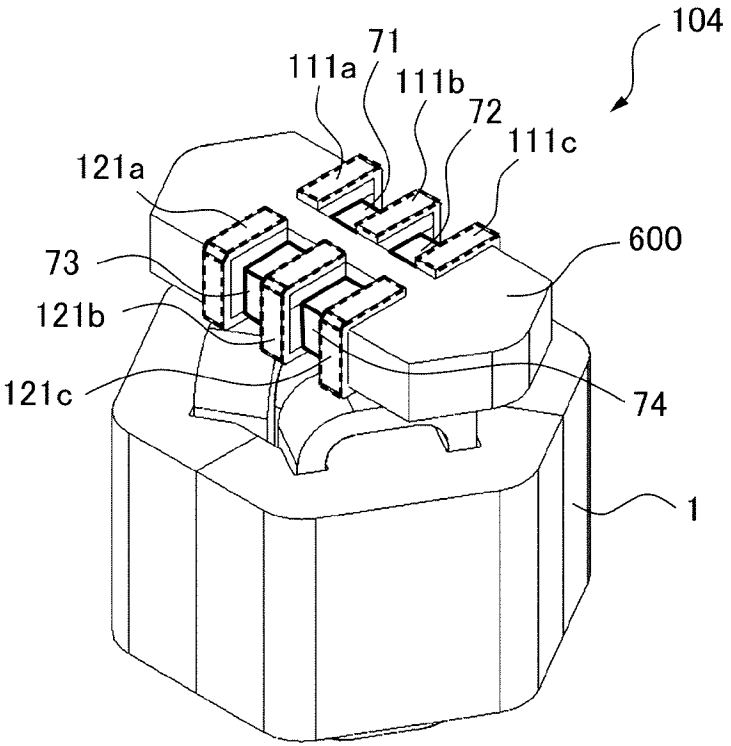
FIG. 9B is a perspective view of the three-phase AC reactor having the coil holder according to the fourth embodiment.
Figure 9A:
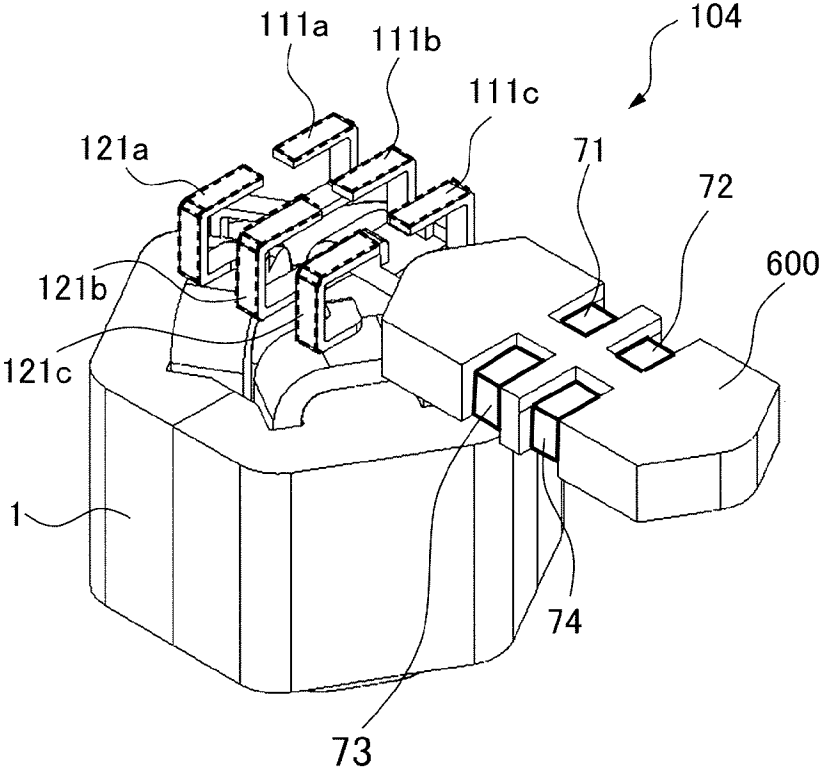
FIG. 9A is a perspective view of the three-phase AC reactor having the coil holder according to the fourth embodiment.

Next, a three-phase AC reactor according to a fourth embodiment will be described. FIGS. 8A and 8B are plan views of the three-phase AC reactor having a coil holder according to the fourth embodiment. FIGS. 9A and 9B are perspective views of the three-phase AC reactor having the coil holder according to the fourth embodiment. The difference between a three-phase AC reactor 104 according to the fourth embodiment and the three-phase AC reactor 103 according to the third embodiment is that a coil holder 600 has slots (71, 72, 73 and 74) each formed between the coil extension members (111*a*, 121*a*, 111*b*, 121*b*, 111*c* and 121*c*) adjoining each other. The other structures of the three-phase AC reactor 104 according to the fourth embodiment are the same as those of the three-phase AC reactor 103 according to the third embodiment, so a detailed description thereof is omitted.

FIGS. 8A and 9A show a state before mounting the coil holder 600 in the three-phase AC reactor, while FIGS. 8B and 9B show a state after mounting the coil holder 600 in the three-phase AC reactor. The coil extension members (111*a*, 121*a*, 111*b*, 121*b*, 111*c* and 121*c*) according to the fourth embodiment have the same shapes as the coil extension members according to the third embodiment. The coil holder 600 according to the fourth embodiment, which is different in structure from the coil holder 60 according to the third embodiment, has the slots (71, 72, 73 and 74) each formed between the coil extension members (111*a*, 121*a*, 111*b*, 121*b*, 111*c* and 121*c*) adjoining each other. The coil holder 600 may be made of an insulating material.

In FIG. 8A, dotted lines drawn on the coil holder 600 indicate positions in which the coil extension members are intended to be disposed. As shown in FIGS. 8B and 9B, the slot 71 is formed between the adjoining coil extension members 111*a* and 111*b*, and the slot 72 is formed between the adjoining coil extension members 111*b* and 111*c*. The slot 73 is formed between the adjoining coil extension members 121*a* and 121*b*, and the slot 74 is formed between the adjoining coil extension members 121*b* and 121*c*. Providing the slots between the adjoining coil extension members, as described in the three-phase AC reactor 104 according to the fourth embodiment, has the effect of easily ensuring certain creepage distances between the coil extension members of individual phases along the surfaces of the coil holder 600.

Figure 10B:
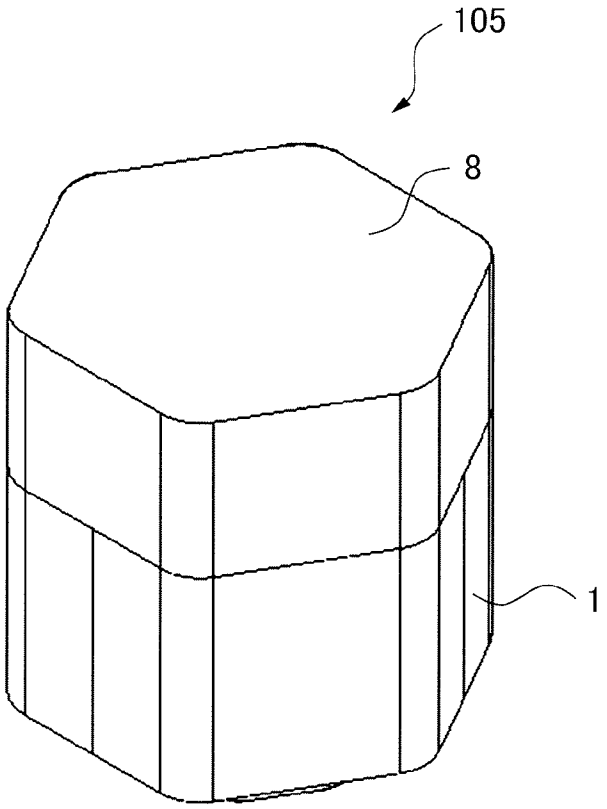
FIG. 10B is a perspective view of the three-phase AC reactor having the upper lid according to the fifth embodiment.
Figure 10A:
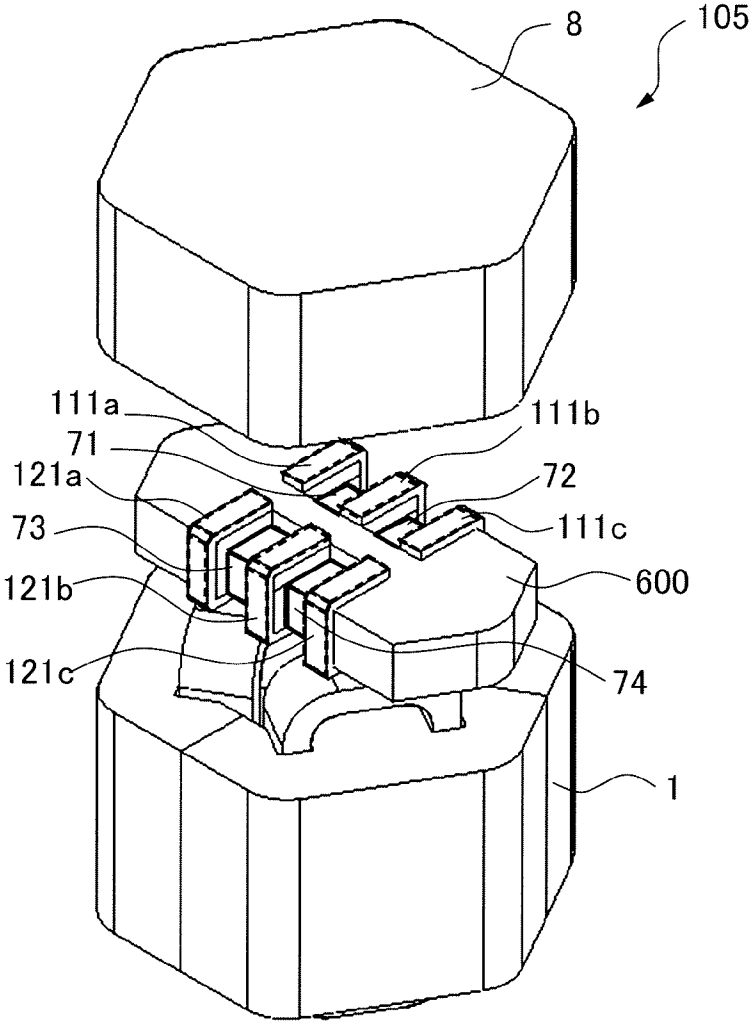
FIG. 10A is a perspective view of a three-phase AC reactor having an upper lid according to a fifth embodiment.

Next, a three-phase AC reactor according to a fifth embodiment will be described. FIGS. 10A and 10B are perspective views of the three-phase AC reactor having an upper lid 8 according to the fifth embodiment. The difference between a three-phase AC reactor 105 according to the fifth embodiment and the three-phase AC reactor 104 according to the fourth embodiment is that the coil holder 600 is covered with the upper lid 8. The other structures of the three-phase AC reactor 105 according to the fifth embodiment are the same as those of the three-phase AC reactor 104 according to the fourth embodiment, so a detailed description thereof is omitted.

In FIGS. 10A and 10B, the upper lid 8 is mounted on the three-phase AC reactor 104 having the coil holder 600 according to the fourth embodiment, but not limited to this example, the upper lid 8 may be mounted on the three-phase AC reactor 102 having the coil holder 6 according to the second embodiment, or the three-phase AC reactor 103 having the coil holder 60 according to the third embodiment. The upper lid 8 is preferably made of an insulating material.

Covering the coil holder 600 with the upper lid 8, as described in the three-phase AC reactor according to the fifth embodiment, prevents adhesion of foreign materials and the like to the coil extension members and the like.

Figure 11:
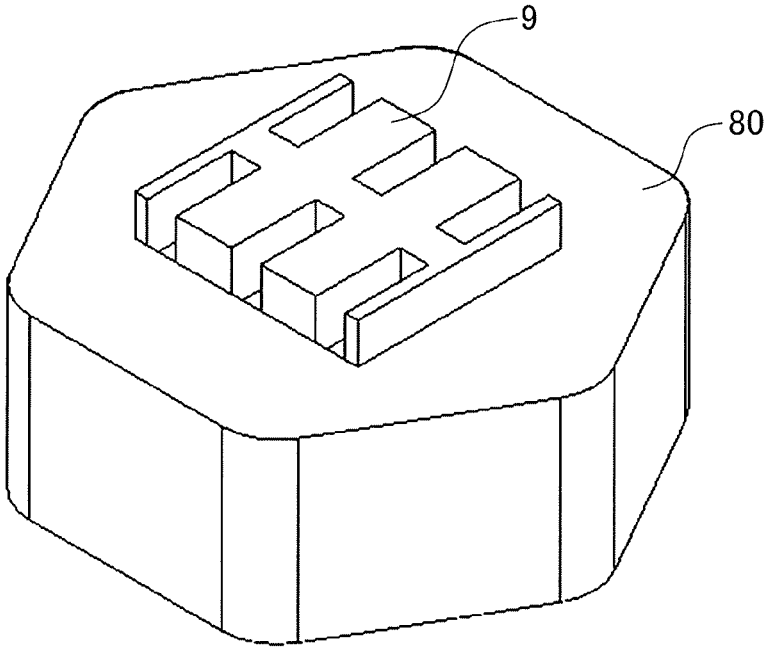
FIG. 11 is a perspective view of an upper lid provided in a three-phase AC reactor according to a sixth embodiment.

Next, a three-phase AC reactor according to a sixth embodiment will be described. FIG. 11 is a perspective view of an upper lid 80 provided in the three-phase AC reactor according to the sixth embodiment. The difference between the three-phase AC reactor according to the sixth embodiment and the three-phase AC reactor 105 according to the fifth embodiment is that the upper lid 80 has walls 9 that enclose the coil extension members disposed on the top surface of the coil holder 600. The other structures of the three-phase AC reactor according to the sixth embodiment are the same as those of the three-phase AC reactor 105 according to the fifth embodiment, so a detailed description thereof is omitted.

FIG. 11, which is the perspective view of the upper lid 80 having the walls 9, shows only an upper surface of the upper lid 80, but the walls 9 extend downward in the perpendicular direction so as to contact the coil holder 600 (see FIG. 10A). Thus, a part of the walls 9 is disposed between the adjoining coil extension members. The walls 9 formed in the upper lid 80 are preferably made of an insulating material.

According to the three-phase AC reactor of the sixth embodiment, providing the walls between the coil extension members of individual phases has the effect of easily ensuring certain spatial distances between the adjoining coil extension members.

Figure 12:
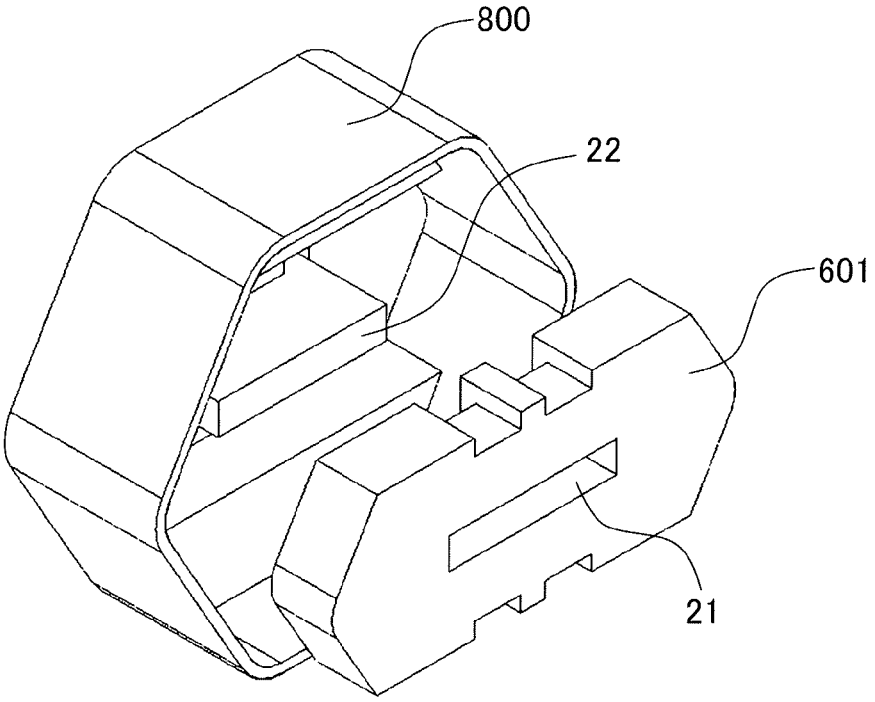
FIG. 12 is a perspective view of a coil holder and an upper lid according to a seventh embodiment.

Next, a three-phase AC reactor according to a seventh embodiment will be described. FIG. 12 is a perspective view of an upper lid 800 provided in the three-phase AC reactor according to the seventh embodiment. The difference between the three-phase AC reactor according to the seventh embodiment and the three-phase AC reactor 105 according to the fifth embodiment is that a coil holder 601 has an opening 21, while the upper lid 800 has a projection 22, and the projection is insertable into the opening 21. The other structures of the three-phase AC reactor according to the seventh embodiment are the same as those of the three-phase AC reactor 105 according to the fifth embodiment, so a detailed description thereof is omitted.

As shown in FIG. 12, in contrast to the upper lid 8 (see FIG. 10A) according to the fifth embodiment, the upper lid 800 according to the seventh embodiment has the projection 22 on a rear side of a top surface of the upper lid 800, in other words, on a surface opposite the coil holder 601.

According to the three-phase AC reactor of the seventh embodiment, since the coil holder 601 has the opening 21, while the upper lid 800 has the projection 22, and the projection 22 is insertable into the opening 21, the position of the coil holder 601 is fixed by securing the upper lid 800.

Figure 13B:
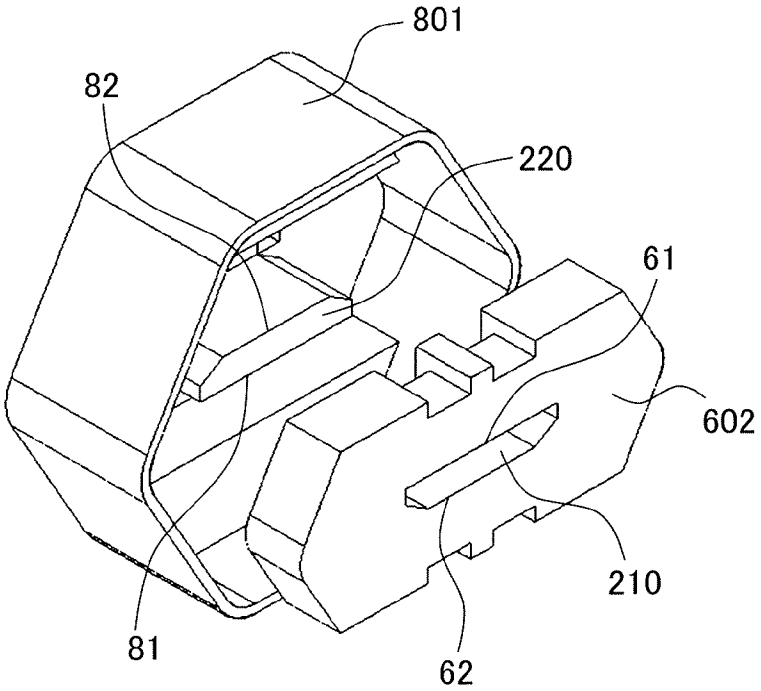
FIG. 13B is a perspective view of the coil holder and the upper lid according to the eighth embodiment.
Figure 13A:
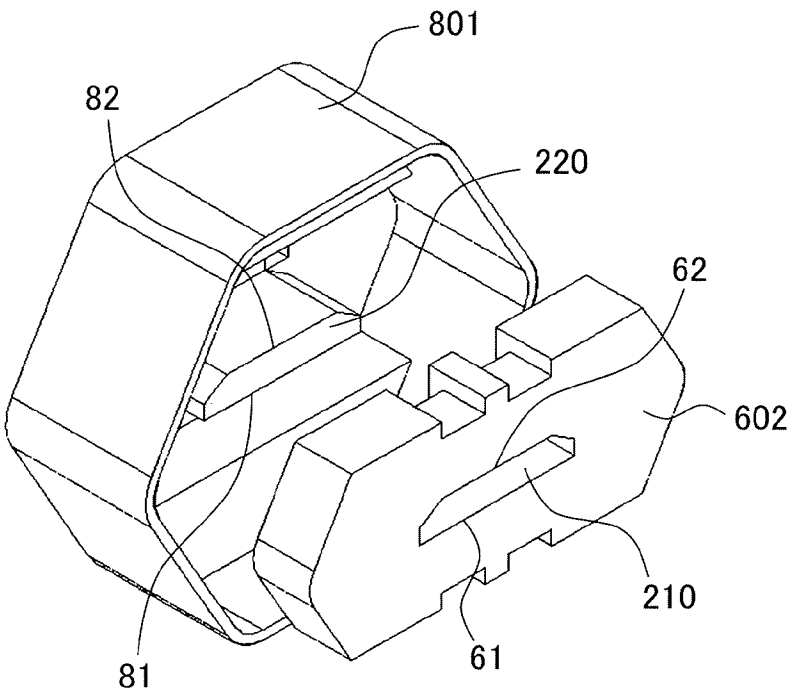
FIG. 13A is a perspective view of a coil holder and an upper lid according to an eighth embodiment.

Next, a three-phase AC reactor according to an eighth embodiment will be described. FIGS. 13A and 13B are perspective views of an upper lid 801 provided in the three-phase AC reactor according to the eighth embodiment. The difference between the three-phase AC reactor according to the eighth embodiment and the three-phase AC reactor according to the seventh embodiment is that a projection 220 of the upper lid 801 is insertable into an opening 210 of a coil holder 602, only when an input direction (61) and an output direction (62) of the coil holder 602 correspond with an input direction (81) and an output direction (82) of the upper lid 801, respectively. The other structures of the three-phase AC reactor according to the eighth embodiment are the same as those of the three-phase AC reactor according to the seventh embodiment, so a detailed description thereof is omitted.

As shown in FIGS. 13A and 13B, in contrast to the upper lid 800 (see FIG. 12) according to the seventh embodiment, the upper lid 801 according to the eighth embodiment has the projection 220 the shape of which is different between the input side 81 and the output side 82.

As shown in FIGS. 13A and 13B, in contrast to the coil holder 601 (see FIG. 12) according to the seventh embodiment, the coil holder 602 according to the eighth embodiment has the opening 210 the shape of which is different between the input side 61 and the output side 62.

The projection 220 of the upper lid 801 can be fitted into the opening 210 of the coil holder 602, as shown in FIG. 13A, only when the input side 81 of the projection 220 is brought into correspondence with the input side 61 of the opening 210, and the output side 82 of the projection 220 is brought into correspondence with the output side 62 of the opening 210.

On the other hand, as shown in FIG. 13B, when the input side 81 of the projection 220 is brought into correspondence with the output side 62 of the opening 210, and the output side 82 of the projection 220 is brought into correspondence with the input side 61 of the opening 210, the projection 220 of the upper lid 801 cannot be fitted into the opening 210 of the coil holder 602.

According to the three-phase AC reactor of the eighth embodiment, the projection of the upper lid cannot be fitted into the opening of the coil holder unless the input side and the output side of the upper lid correspond in direction with the input side and the output side of the coil holder, respectively, thus allowing a reduction of errors in assembly of the three-phase AC reactor.

Figure 14:
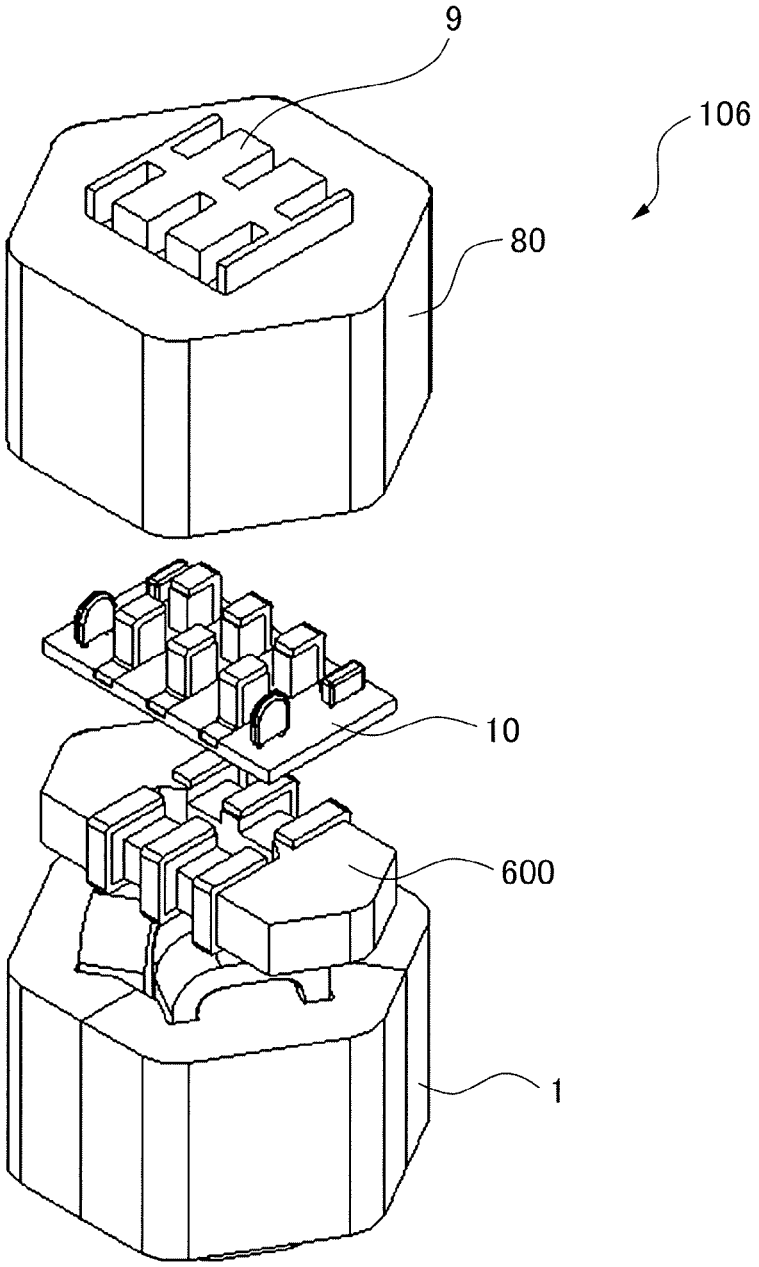
FIG. 14 is a perspective view of a three-phase AC reactor having a surge protector according to a ninth embodiment.

Next, a three-phase AC reactor according to a ninth embodiment will be described. FIG. 14 is a perspective view of the three-phase AC reactor having a surge protector according to the ninth embodiment. The difference between a three-phase AC reactor 106 according to the ninth embodiment and the three-phase AC reactor 105 according to the fifth embodiment is that a surge protector 10 is provided between the coil holder 600 and the upper lid 80. The other structures of the three-phase AC reactor 106 according to the ninth embodiment are the same as those of the three-phase AC reactor 105 according to the fifth embodiment, so a detailed description thereof is omitted.

The surge protector 10 is a circuit board having a surge protection function. The upper lid 80 has the walls 9 in FIG. 14, but not limited to this example, no wall may be provided.

Conventionally, it is necessary to provide surge protectors are outside the reactor. However, according to the three-phase AC reactor of the ninth embodiment, the surge protector is provided inside the reactor, thus allowing a reduction in size of an inverter system.

Figure 15:
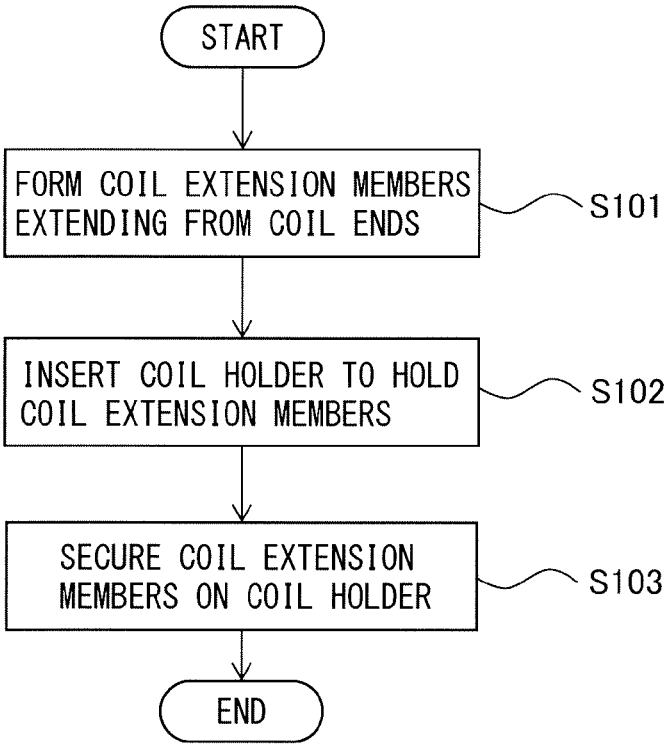
FIG. 15 is a flowchart of a method for manufacturing any of the three-phase AC reactors according to the embodiments.

Next, a method for manufacturing any of the three-phase AC reactors according to the embodiments will be described. FIG. 15 is a flowchart of the method for manufacturing any of the three-phase AC reactors according to the embodiments. FIGS. 16A to 16D are perspective views of a three-phase AC reactor in each step of the method for manufacturing any of the three-phase AC reactors according to the embodiments. The method for manufacturing any of the three-phase AC reactors according to the embodiments is a method for manufacturing a three-phase AC reactor that includes a peripheral iron core that forms the outer periphery of the three-phase AC reactor, and at least three iron core coils that are in contact with or connected to inner surfaces of the peripheral iron core. Each of the three iron core coils includes an iron core and a coil wound around the iron core. The at least three iron core coils form gaps between the iron core coils adjoining each other so as to be magnetically connected through the gaps. The method for manufacturing any of the three-phase AC reactors according to the embodiments includes the steps of forming the coil extension members that extend from the coil ends, inserting the coil holder to hold the coil extension members, and securing the coil extension members on the coil holder.

Figure 16A:
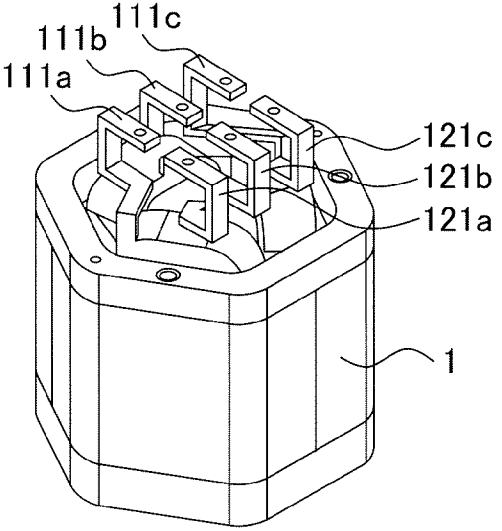
FIG. 16A is a perspective view of a three-phase AC reactor in a first step of the method for manufacturing any of the three-phase AC reactors according to the embodiments.

In the method for manufacturing any of the three-phase AC reactors according to the embodiments, in step S101, the coil extension members (111*a*, 121*a*, 111*b*, 121*b*, 111*c* and 121*c*) are formed so as to extend from the coil ends (FIG. 16A).

Figure 16B:
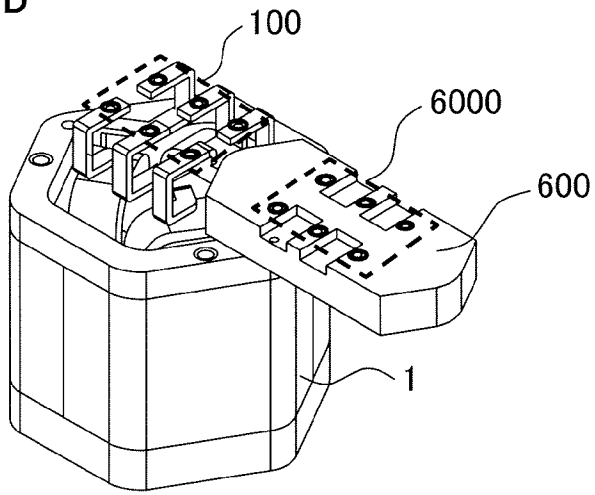
FIG. 16B is a perspective view of the three-phase AC reactor in a second step of the method for manufacturing any of the three-phase AC reactors according to the embodiments.

Next, in step S102, the coil holder 600 is inserted to hold the coil extension members (111*a*, 121*a*, 111*b*, 121*b*, 111*c* and 121*c*) (FIG. 16B). As shown in FIG. 16B, screw holes are formed in an area 6000 indicated by a dotted line in the coil holder 600, so as to correspond to screw holes provided in the coil extension members in an area 100.

Figure 16C:
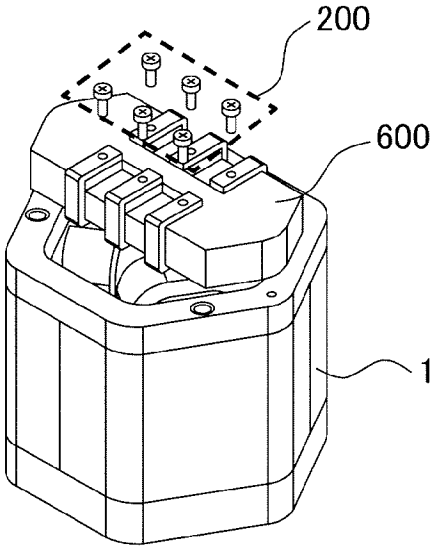
FIG. 16C is a perspective view of the three-phase AC reactor in a third step of the method for manufacturing any of the three-phase AC reactors according to the embodiments.
Figure 16D:
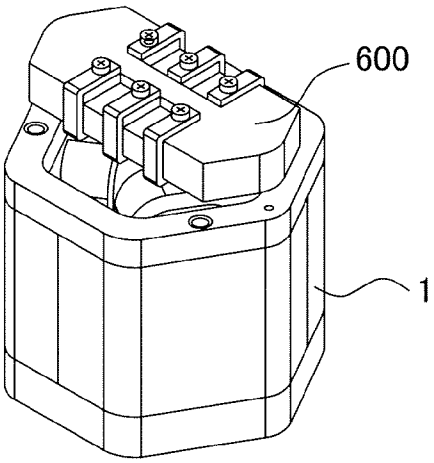
FIG. 16D is a perspective view of the three-phase AC reactor in a fourth step of the method for manufacturing any of the three-phase AC reactors according to the embodiments.

Next, in step S103, the coil extension members (111*a*, 121*a*, 111*b*, 121*b*, 111*c* and 121*c*) are secured on the coil holder 6000 (FIGS. 16C and 16D). As shown in FIG. 16C, by fastening screws 200 into the screw holes provided in the coil extension members and the coil holder 600, the coil extension members are secured on the coil holder.

Figure 17B:
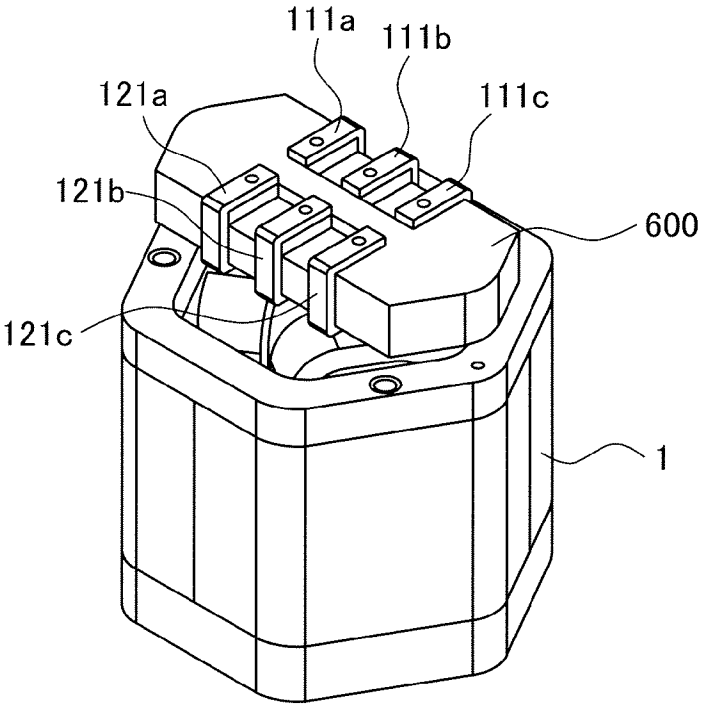
FIG. 17B is a perspective view of the three-phase AC reactor in another part of the step of the example of the method for manufacturing any of the three-phase AC reactors according to the embodiments.
Figure 17A:
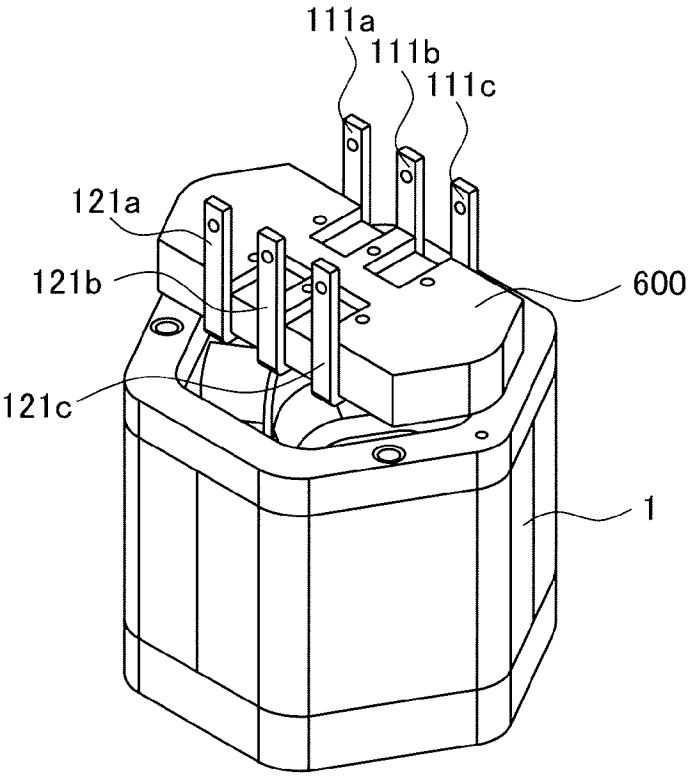
FIG. 17A is a perspective view of a three-phase AC reactor in a part of a step of another example of the method for manufacturing any of the three-phase AC reactors according to the embodiments.

FIGS. 17A and 17B are perspective views of a three-phase AC reactor in a part of a step of another example of the method for manufacturing any of the three-phase AC reactors according to the embodiments. In another example of the method for manufacturing any of the three-phase AC reactors according to the embodiments, the order of step S101 and step S102 may be reversed. In other words, as shown in FIG. 17A, the coil holder 600 may be disposed before bending the coil ends of the coil extension members (111*a*, 121*a*, 111*b*, 121*b*, 111*c* and 121*c*), and thereafter, as shown in FIG. 17B, the coil ends of the coil extension members (111*a*, 121*a*, 111*b*, 121*b*, 111*c* and 121*c*) may be bent.

The method for manufacturing any of the three-phase AC reactors according to the embodiments can omit a step of connecting between the coils and relays and a step of connecting between the relays and an input and output terminal base, thus allowing a reduction in production man-hours.

The three-phase AC reactor and the method for manufacturing the three-phase AC reactor eliminate the need for providing relays and an input and output terminal base, thus allowing a reduction in manufacturing cost of the three-phase AC reactor.

What is claimed is:

1. A three-phase AC reactor comprising:

a peripheral iron core forming an outer periphery; and at least three iron core coils being in contact with or connected to inner surfaces of the peripheral iron core, each of the iron core coils including an iron core and a coil wound around the iron core;

wherein:

the at least three iron core coils form gaps between the iron core coils adjoining each other so as to be magnetically connectable through the gaps, the coils each have coil extension members extending from coil ends to connection points to an external device, the three-phase AC reactor is secured by a coil holder for holding the coil extension members, openings are formed on a top surface of the coil holder in positions corresponding to each of the coil extension members, protruding lengths of each of the coil extension members protrude and extend from the openings of the coil holder to respective distal ends, the protruding lengths of each of the coil extension members are altered in shape by bending to extend from the openings to the respective distal ends in an orientation that is substantially parallel with the top surface of the coil holder, and the coil extension members are formed so as to be integral with windings of the coils.

2. The three-phase AC reactor according to claim 1, wherein out of the coil extension members input-side coil extension members are aligned along a first straight line so as to enclose one side surface of the coil holder; output-side coil extension members are aligned along a second straight line so as to enclose the other side surface of the coil holder; and the first straight line and the second straight line are in parallel.

3. The three-phase AC reactor according to claim 2, wherein the coil holder has slots provided between the coil extension members adjoining each other.

4. The three-phase AC reactor according to claim 1, further comprising an upper lid for covering the coil holder.

5. The three-phase AC reactor according to claim 4, wherein the upper lid has a wall to enclose the coil extension member disposed on a top surface of the coil holder.

6. The three-phase AC reactor according to claim 4, further comprising a surge protector provided between the coil holder and the upper lid.

7. The three-phase AC reactor according to claim 4, wherein the coil holder has an opening;

the upper lid has a projection; and the projection is insertable into the opening.

8. The three-phase AC reactor according to claim 7, wherein the projection of the upper lid is insertable into the opening of the coil holder only when an input direction and an output direction of the coil holder correspond with an input direction and an output direction of the upper lid, respectively.

* * * * *